US008955671B1

(12) United States Patent
Barnett

(10) Patent No.: US 8,955,671 B1
(45) Date of Patent: Feb. 17, 2015

(54) QUICK-RELEASE PACKAGING

(71) Applicant: David B. Barnett, Boulder, CO (US)

(72) Inventor: David B. Barnett, Boulder, CO (US)

(73) Assignee: PopSockets LLC, Boulder, CO (US)

( * ) Notice: Subject to any disclaimer, the term of this patent is extended or adjusted under 35 U.S.C. 154(b) by 0 days.

(21) Appl. No.: 14/015,742

(22) Filed: Aug. 30, 2013

(51) Int. Cl.
*B65D 45/00* (2006.01)
*B65D 5/44* (2006.01)

(52) U.S. Cl.
CPC ..... *B65D 5/44* (2013.01); *Y10S 206/806* (2013.01)
USPC ..... 206/1.5; 206/806

(58) Field of Classification Search
USPC ..... 206/758, 769, 770, 775, 776, 777, 1.5, 206/468, 806
See application file for complete search history.

(56) References Cited

U.S. PATENT DOCUMENTS

| | | | | |
|---|---|---|---|---|
| 5,896,996 | A * | 4/1999 | Chuang | 206/769 |
| 6,105,784 | A * | 8/2000 | Salminen et al. | 206/775 |
| 6,375,010 | B1 * | 4/2002 | Thibault | 206/762 |
| 7,322,467 | B2 * | 1/2008 | Youngblood | 206/233 |
| 7,681,755 | B2 * | 3/2010 | Roesler | 220/788 |
| D632,169 | S * | 2/2011 | Ruth | D9/423 |

* cited by examiner

*Primary Examiner* — Jacob K Ackun
(74) *Attorney, Agent, or Firm* — Jennifer L. Bales; Macheledt Bales LLP

(57) ABSTRACT

A quick-release package includes a box enclosure and an insert. The insert slides into the open bottom of the box enclosure, and includes a locking extension which slides into a slot on the top of the box enclosure and locks the insert into place. The slot forms a wide portion toward the back surface of the box enclosure and a narrower button release portion toward the front surface of the box enclosure. The insert locking extension includes a button configured to catch on the back surface of the wider portion of the top slot in a first position and which, when pressed, moves into the button release portion of the slot and releases the locking extension and hence the insert from the box enclosure.

17 Claims, 5 Drawing Sheets

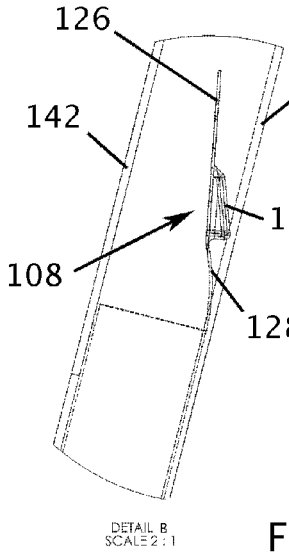
Figure 7B
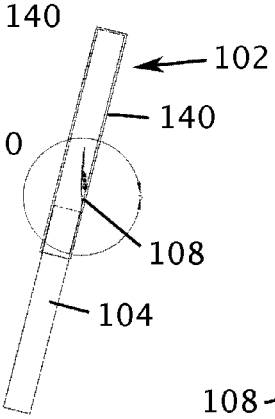
Figure 7A
Figure 7D
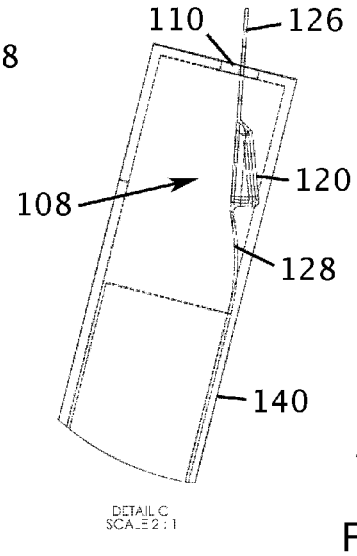
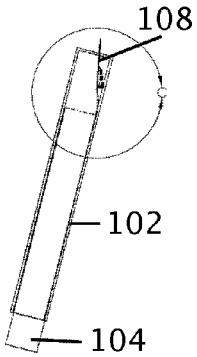
Figure 7C
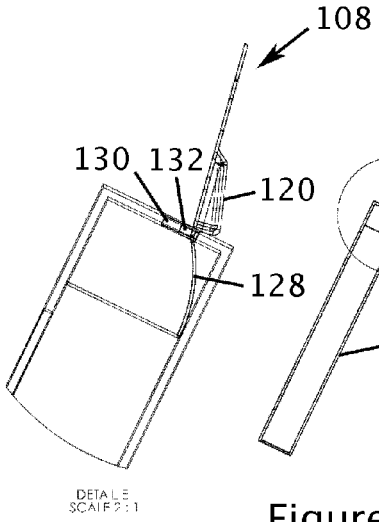
Figure 7F
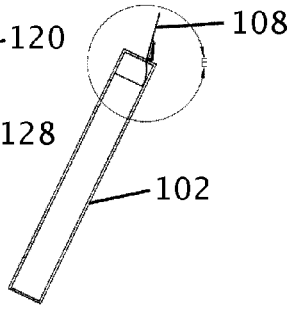
Figure 7E

QUICK-RELEASE PACKAGING

BACKGROUND OF THE INVENTION

1. Field of the Invention

The present invention relates to packaging. In particular, the present invention relates to insert packaging including quick-release features to release the insert from a box enclosure.

2. Discussion of Related Art

FIG. 1 (Prior Art) shows a conventional package 19 (described in U.S. Pat. No. 6,105,784) including an insert 11 for an object to be contained and displayed in a surrounding box 3. Insert 11 includes a catch 14 which fits into an aperture 8 on box 3, to retain insert 11 within box 3. Insert 11 further includes a shoulder 17. To release insert 11 from box 3, the user presses catch 14 to retract it from aperture 8. Then insert 11 may be slid out of box 3.

This prior art package 19 has several disadvantages. It requires a hole (aperture 8) in the back of the box. This is disruptive to the standard package and prevents the entire back of the box from being used for graphics. In addition, it is prone to accidental release, since catch 14 may be accidentally pressed by, for example, an adjacent box. What is needed is a quick-release insert packaging where the insert is protected from accidental release from the box enclosure, and where the backside of the box enclosure does not require a hole.

SUMMARY OF THE INVENTION

One or more embodiments of the present invention are directed to quick-release insert packaging where an insert is protected from accidental release from the box enclosure, and where the backside of the box enclosure does not require a hole. A package according to the present invention includes a box enclosure and an insert. The insert slides into the open bottom of the box enclosure, and includes a locking extension that slides into a slot on the top of the box enclosure and locks the insert into place. The slot forms a wide portion toward the back surface of the box enclosure and a narrower button release portion toward the front surface of the box enclosure. The insert locking extension includes a button configured with a shoulder to catch on the back surface of the wider portion of the top slot in a first position. The button, when pressed, moves into the button release portion of the slot and releases the locking extension and hence the insert from the box enclosure. The locking extension forms a cutaway around the button to allow the button to move forward, away from the bottom of the locking extension.

When the insert is being inserted into the box enclosure, the button presses against the back of the box enclosure and biases the top of the locking extension away from the back. The locking extension is formed of a resilient material such as 0.5 mm thick thermoformed polyethylene terephthalate (PET) plastic, so it in turn biases the button into the box enclosure back. The combination of these two biasing forces results in the top of the locking extension being held a fixed distance away from the back of the box enclosure, such that it is in position to slide into the wide portion of the top slot of the box enclosure.

Once the locking extension has been inserted, the resilience of the locking extension material biases the locking button backward so that it catches on the back edge of the wide portion of the top slot. To release the locking extension, and hence the insert, the button is pushed forward into the narrower button release portion of the top slot so that the button shoulder no longer catches on the back of the top slot.

This addresses the problem of accidental release as follows. First, when the insert is engaged with the box, the button is located inward from the top back edge of the box; it is thus protected by this edge from objects that collide with, or press against, the backside of the box. Second, the button and its shoulder are embedded within the larger locking extension, so that the top and side edges of the button are protected by the adjacent edges of the locking extension, collisions against which cannot serve to activate the release mechanism due to the fact that the locking extension is too wide to fit into the narrow portion of the top slot. So the only way to activate the release mechanism is to apply precise pressure to the button itself, and not its surrounding protective bodies.

Those skilled in the art will appreciate that configurations similar to embodiments shown and described herein may be used.

BRIEF DESCRIPTION OF THE DRAWINGS

FIGS. 7A-7F show the process of inserting the insert into the box enclosure. FIG. 7A is a side hidden-line view of the insert at the beginning of the insertion process. FIG. 7B is a detailed view of a portion of FIG. 7A. FIG. 7C is a side hidden-line view of the insert near the end of the insertion process. FIG. 7D is a detailed view of a portion of FIG. 7C. FIG. 7E is a side cross-section view of the insert inserted into the box enclosure. FIG. 7F is a detailed view of a portion of FIG. 7E.

FIG. 8A is a top view of the insert inserted into the box enclosure. FIG. 8B is a detailed view of a portion of FIG. 8A. FIG. 8C shows the button of the insert in its activated position with the insert ready to release from the box enclosure.

DETAILED DESCRIPTION OF THE INVENTION

The following table lists elements of the illustrated embodiments of the invention and their associated reference numbers for convenience.

| Ref. No. | Element |
|---|---|
| 100 | Quick-release package |
| 102 | Box enclosure |
| 104 | Insert |
| 106 | Box enclosure display window |

-continued

| Ref. No. | Element |
|---|---|
| 108 | Insert locking extension |
| 110 | Box enclosure top slot for locking extension |
| 120 | Locking button |
| 121 | Locking button shoulder |
| 122 | Extension cutaway |
| 124 | Rack hanger aperture |
| 126 | Top of locking extension |
| 128 | Bottom of locking extension |
| 130 | Button release portion of box top slot |
| 132 | Wide portion of box top slot |
| 140 | Back wall of box enclosure |
| 142 | Front wall of box enclosure |

Figure 1:
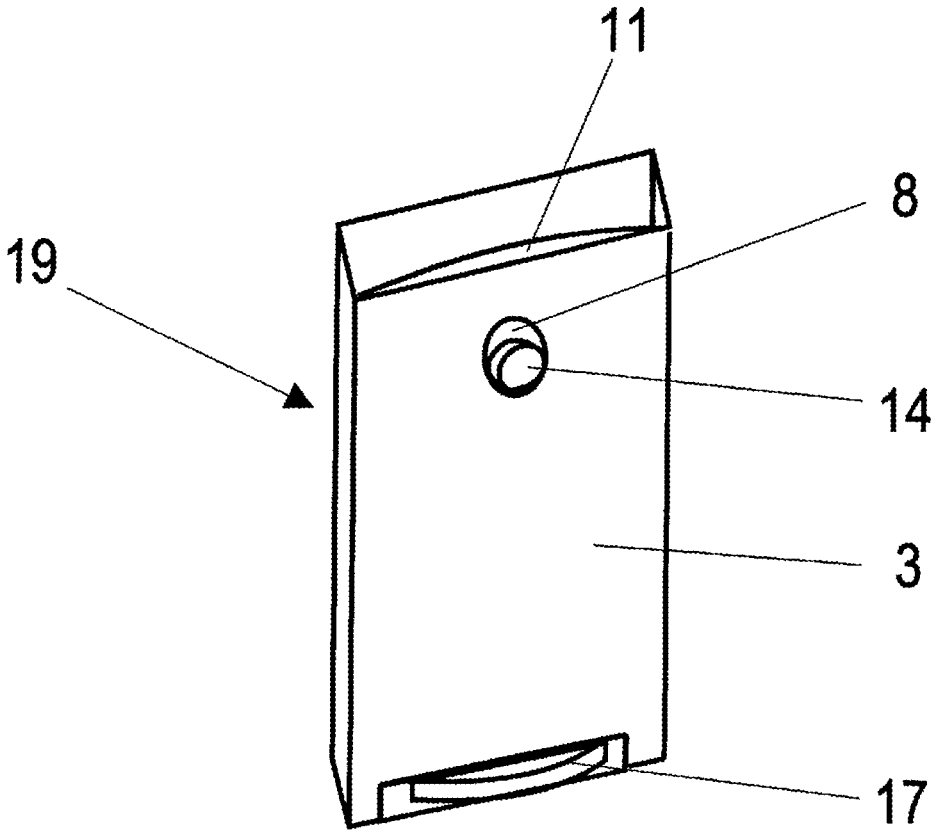
Figure 1 (Prior Art)
FIG. 1 (Prior Art) comprises an isometric view of a conventional releasable insert package.
Figure 2:
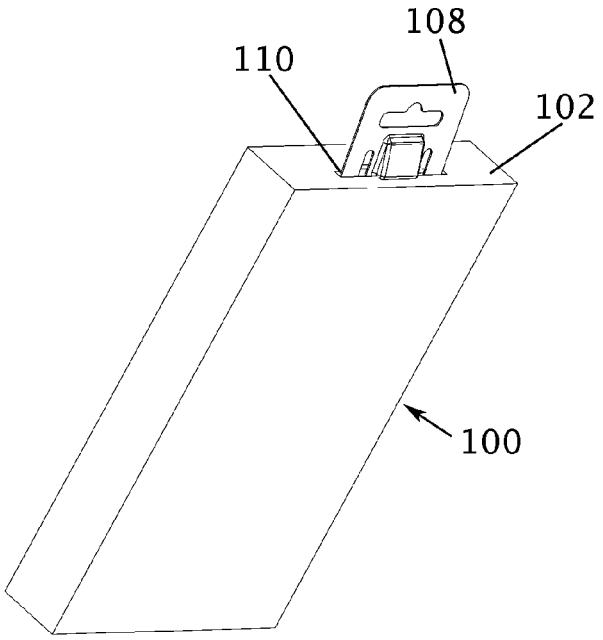
FIG. 2 comprises a back isometric view of an insert package including an insert and a box enclosure according to the present invention.

FIG. 2 comprises a back isometric view of a quick-release package 100 including an insert 104 and a box enclosure 102 according to at least one embodiment of the present invention. Insert 104 slides into box enclosure 102 and is locked in place by locking extension 108 within box enclosure top slot 110.

Figure 3B:
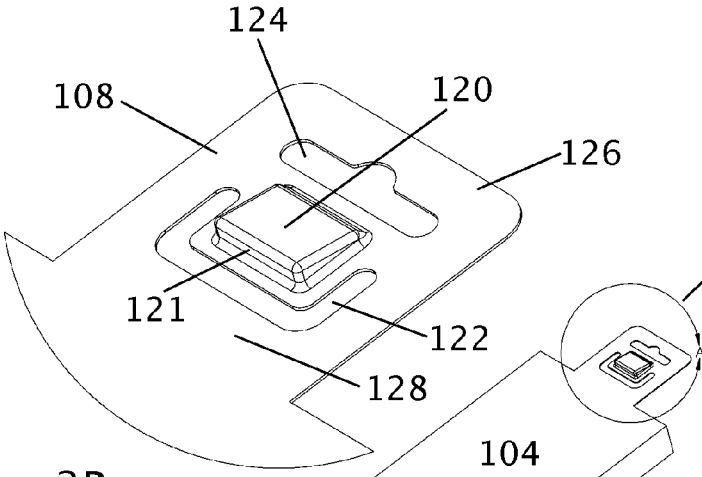
FIG. 3B is an expanded view of a portion of FIG. 3A, showing its top extension in detail.
Figure 3A:
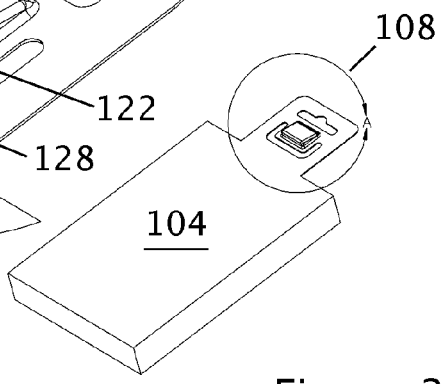
FIG. 3A comprises a back isometric view of an insert of FIG. 2.

FIG. 3A comprises a back isometric view of insert 104 with its locking extension 108 at the top. FIG. 3B is an expanded view of section A of FIG. 3A, showing locking extension 108 in detail.

Insert 104 may comprise a clamshell which opens to permit a product to be inserted within. Generally insert 104 is transparent at least in part to allow the product to be seen through a window 106 formed in box enclosure 102 (see FIG. 4).

Locking extension 108 includes a locking button 120, a top portion 126, a bottom portion 128, a cutaway 122 to allow locking button 120 to be pressed forward to pivot away from portion 128 of locking extension 108, and a rack hanger aperture 124 to allow package 100 to be hung on a peg (not shown). Locking extension 108 is designed to automatically slide into box enclosure top slot 110 and lock into place when insert 104 is inserted into box enclosure 102. It is designed to release when button 120 is pressed forward.

Figure 4:
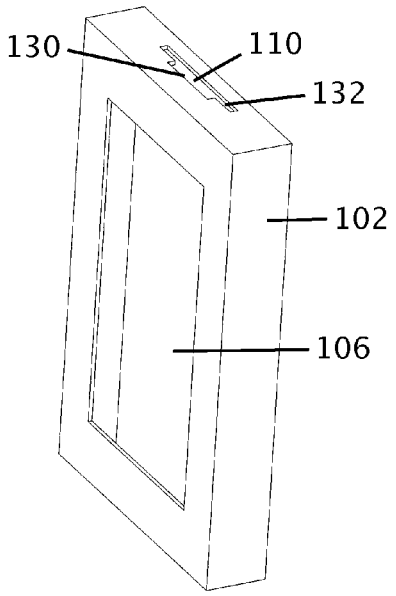
FIG. 4 comprises a front isometric view of the box enclosure of FIG. 2.

FIG. 4 is a front isometric view of box enclosure 102. It is open at the bottom, to allow the insertion and release of insert 104. It includes a front display window 106 (for example an opening) to display the product attached to, or contained within, insert 104. Finally, it includes a top slot 110 for insertion and retention of locking extension 108. Top slot 110 includes a narrower button release area 130 and a wider area 132 for the entire locking extension 108. Note that button release portion 130 of top slot 110 is situated toward the front of box enclosure 102, and wide portion 132 is situated toward the back of box enclosure 102 in the embodiment shown in FIG. 4. Those skilled in the art will appreciate that the configuration of slots could be changed.

Figure 5:
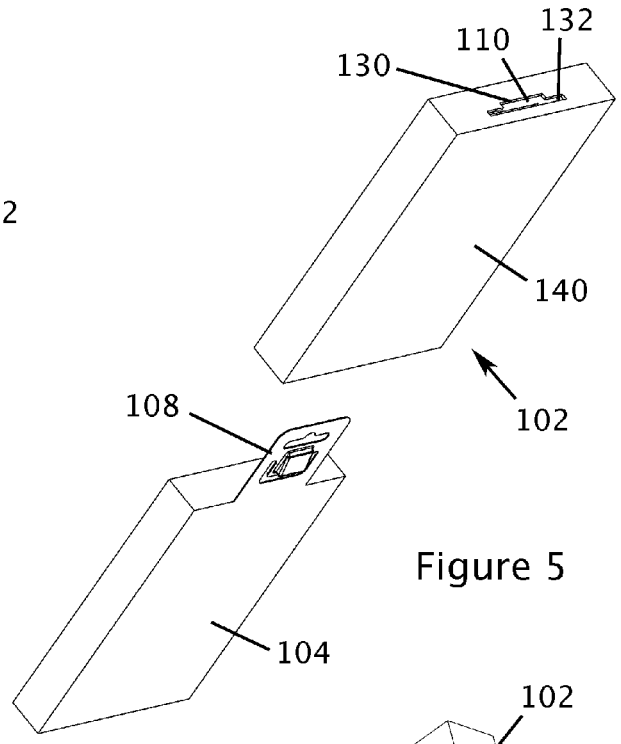
FIG. 5 is a back isometric view of the box enclosure and insert of FIG. 2, where the insert is positioned for insertion into the box enclosure.

FIG. 5 is a back isometric view of box enclosure 102 and insert 104, where insert 104 is positioned for insertion into box enclosure 102, such that locking button 120 faces toward the back 140 of box enclosure 102. FIG. 5 illustrates one specific example of the present invention which could comprise a box enclosure 102 that is 0.5 mm thick paper (or alternatively 0.4 mm), and that has a wide slot 132 that is 53 mm wide by 3 mm deep and a narrow (button release) slot 130 that is 32 mm wide by 5 mm deep. In this example, box enclosure 102 is 160 mm tall by 24 mm deep by 108 mm wide.

Insert 104 in this example comprises a thermoformed, transparent, 0.5 mm thick polyethylene terephthalate (PET) clamshell having locking button 120 sized 19 mm wide, 8 mm tall, 4 mm deep at the shoulder, and cutaway 122 sized 4.5 mm thick. This embodiment is especially useful for small, heavy items such as mobile electronic devises or cases for mobile electronic devices. Such small heavy items cause insert 104 to drop cleanly out of box enclosure 102 when button 120 is depressed, without requiring a user to push or pull insert 104.

Figure 6:
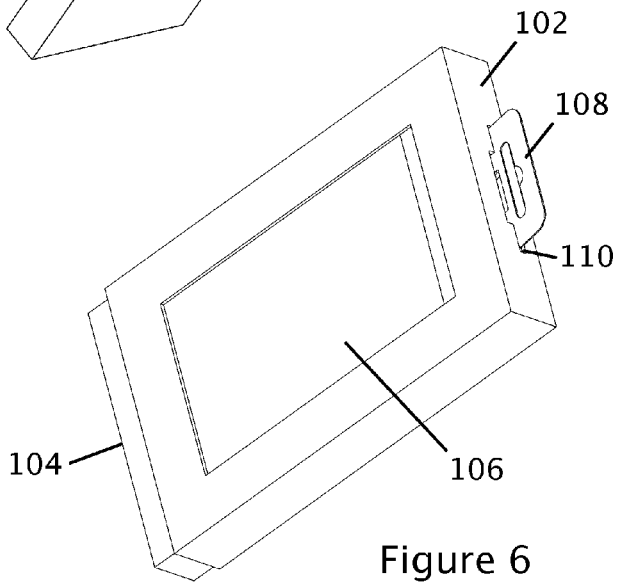
FIG. 6 comprises a front isometric view of the box enclosure and insert, where the insert is partially inserted into the box enclosure.

FIG. 6 comprises a front isometric view of box enclosure 102 and insert 104, where insert 104 has been partially inserted into box enclosure 102.

FIGS. 7A-7F show the process of inserting insert 104 into box enclosure 102 and locking it into place. FIG. 7A is a side hidden-line view of insert 104 at the beginning of the insertion process. FIG. 7B is a detailed view of portion B of FIG. 7A, showing the position of locking extension 108 within box enclosure 102. Note that locking button 120 presses against the back wall 140 of box enclosure 102, bending the top 126 of locking extension 108 toward the front wall 142 of box enclosure 102. Bottom 128 of locking extension 108 is flexed, biasing locking extension 108 toward the back 140 of box enclosure 102. Thus top 126 of locking extension 108 is at a fixed distance from back 140. This positions top 126 properly for insertion into wide portion 132 of top slot 110, as shown in the following figures.

FIG. 7C is a side hidden-line view of insert 104 near the end of the insertion process, as locking extension 108 is threaded into top slot 110. FIG. 7D is a detailed view of the top of box enclosure 102, showing the position of locking extension 108. Note that button 120 is beveled in this embodiment to slide through top slot 110 as the insertion process is completed.

FIG. 7E is a side hidden-line view of insert 104 fully inserted into box enclosure 102. FIG. 7F is a detailed view of locking extension 108 locked into place within top slot 110. Note that bottom 128 of locking extension 108 is flexed, biasing locking extension 108 toward the back 140 of box enclosure 102, which prevents button 120 from releasing without direct forward pressure on button 120. Button 120 is protected from accidental pressing by both the back edge of box enclosure 102 and the surrounding areas of locking extension 108.

Figure 8A:
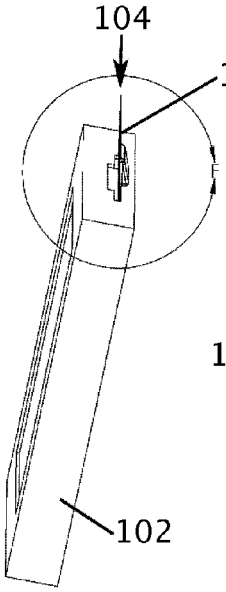
FIGS. 8A-C show the process of releasing the insert from the box enclosure.
Figure 8B:
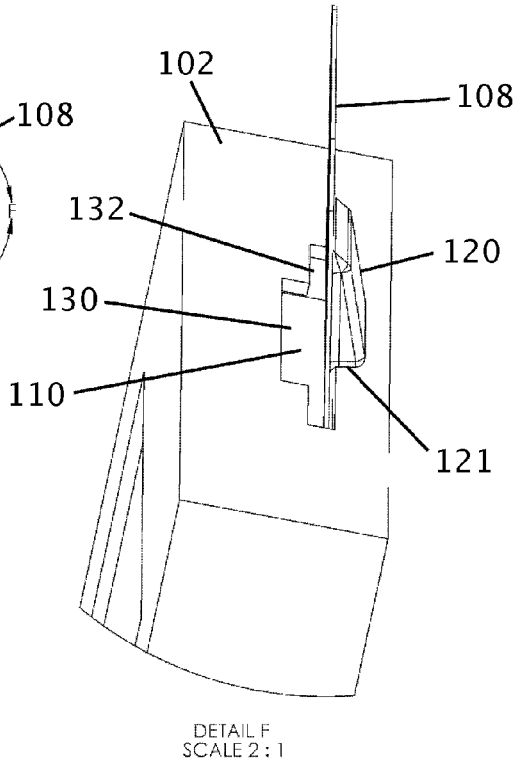
Figure 8C:
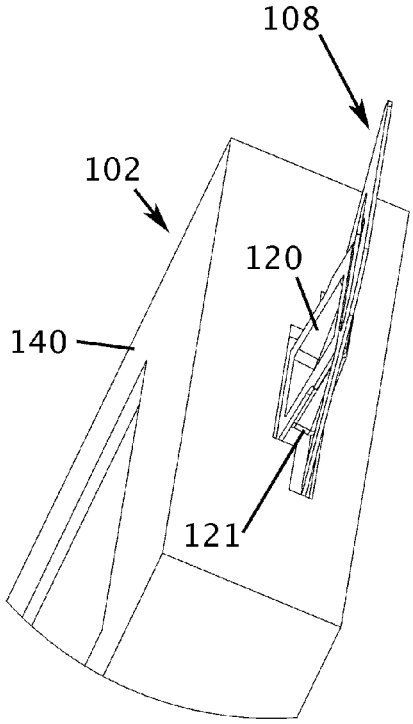

FIGS. 8A-C show the process of releasing insert 104 from box enclosure 102. FIG. 8A is a top view of insert 104 locked in place within box enclosure 102. FIG. 8B is a detailed view of the top of box enclosure 102 and locking extension 108. FIG. 8C shows the insert being released from the box enclosure.

As shown in FIG. 7E, button 120 is biased toward the back of box enclosure 102. This causes locking button shoulder 121 to catch on the back edge of wide portion 132 of top slot 110, locking insert 104 in place. FIG. 8C shows how locking extension 108 is released, allowing insert 104 to drop out of box enclosure 102. Extension cutaway 122 (seen in FIG. 3B) allows button 120 to be pressed toward front 142 of box enclosure 102. Button release portion 130 of top slot provides a place for button 120 to slide out, after moving forward and releasing shoulder 121 from the back of top slot 110. This allows locking extension 108 to slide out of top slot 110 and then out of box enclosure 102 entirely, reversing the process seen in FIGS. 7A-7E.

While the exemplary preferred embodiments of the present invention are described herein with particularity, those skilled in the art will appreciate various changes, additions, and applications other than those specifically mentioned, which are within the spirit of this invention. For example differences in button shape and size
differences in material of insert and box
differences in size and shape of extension cutaway
differences in size and shape of top slot Note that the terms "top," "bottom," "front," and "back" are used herein for convenience when referring to the figures, but are not intended to limit the invention to a specific orientation or configuration.

What is claimed is:

1. Packaging comprising:

a box enclosure having a front surface, a back surface, an open bottom and a top forming a top slot; and an insert having a top forming a locking extension and configured to slide into the box enclosure through the open bottom of the box enclosure, and wherein the locking extension is configured to slide into the box enclosure top slot;

wherein the box enclosure top slot forms a wide portion toward the back surface of the box enclosure and a narrower button release portion toward the front surface of the box enclosure; and wherein the locking extension includes a locking button configured to catch on the back surface of the wider portion of the top slot in a neutral position and is configured to move into the button release portion of the top slot when the button is pressed.

2. The packaging of claim 1, wherein a portion of the insert is transparent and wherein one of either the front surface or the back surface of the box enclosure forms a window configured to allow the transparent portion of the insert to be seen.

3. The packaging of claim 1 wherein the locking extension further forms an extension cutaway around a portion of the locking button, wherein the cutaway allows the locking button to move easily into and out of the neutral position.

4. The packaging of claim 3 wherein the locking extension is constructed and arranged such that, while the insert slides into the box enclosure, the locking button presses against the box enclosure, thereby biasing the locking extension into a position allowing for locking extension insertion into the box enclosure top slot.

5. The packaging of claim 1 wherein the locking extension is constructed and arranged such that, while the insert slides into the box enclosure, the locking button presses against the box enclosure, thereby biasing the locking extension into a position allowing for locking extension insertion into the box enclosure top slot.

6. The packaging of claim 5 wherein the locking extension is formed of a resilient material and wherein the resilience of the locking extension material results in the biasing.

7. The packaging of claim 1 wherein the locking extension further forms an aperture configured to allow the packaging to hang on a peg.

8. The packaging of claim 1 wherein the box enclosure comprises paper and the insert comprises plastic.

9. The packaging of claim 8 wherein the insert comprises a thermoformed, transparent, PET clamshell.

10. The packaging of claim 8 wherein the wide portion of the top slot is on the order of 40-60 mm wide and 2-4 mm deep and the narrower button release portion is on the order of 20-40 mm wide and 3-7 mm deep.

11. The packaging of claim 10 wherein the button is on the order of 17-21 mm wide, 6-10 mm tall, and 2-6 mm deep at the shoulder.

12. The packaging of claim 11, wherein the locking extension further forms an extension cutaway around a portion of the locking button.

13. The method of packaging a product comprising the steps of:

(a) forming a box enclosure having a front surface, a back surface, an open bottom and a top slot;

(b) forming an insert having a top locking extension, configuring the insert to slide into the box enclosure through the open bottom of the box enclosure, and configuring the locking extension to slide into the box enclosure top slot;

(c) configuring the insert to house the product;

(d) forming the box enclosure top slot with a wide portion toward the back surface of the box enclosure and a narrower button release portion toward the front surface of the box enclosure; and (e) forming the locking extension with a locking button configured to catch on the back surface of the wider portion of the top slot in a neutral position and to move into the button release portion of the top slot when the button is pressed.

14. The method of claim 13, wherein the step of forming the insert forms a transparent insert and wherein the step of forming the box enclosure forms a window in the box enclosure.

15. The method of claim 13 wherein the step of forming the locking extension further includes the step of forming an extension cutaway around a portion of the locking button.

16. The method of claim 15 wherein step (b) includes the steps of forming the locking extension of a resilient material and configuring the locking extension such that while the insert slides into the box enclosure, the locking button presses against the box enclosure, thereby biasing the locking extension into a position allowing for locking extension insertion into the box enclosure top slot.

17. The method of claim 13 wherein step (b) includes the steps of forming the locking extension of a resilient material and configuring the locking extension such that while the insert slides into the box enclosure, the locking button presses against the box enclosure, thereby biasing the locking extension into a position allowing for locking extension insertion into the box enclosure top slot.

* * * * *